US007328528B2

(12) United States Patent
Caminiti

(10) Patent No.: US 7,328,528 B2
(45) Date of Patent: Feb. 12, 2008

(54) REMOVABLY ATTACHABLE DECORATION FOR FOOTWEAR

(76) Inventor: Holly Caminiti, 7 Parkwood La., Mendham, NJ (US) 07945

( * ) Notice: Subject to any disclaimer, the term of this patent is extended or adjusted under 35 U.S.C. 154(b) by 421 days.

(21) Appl. No.: 10/997,824

(22) Filed: Nov. 24, 2004

(65) Prior Publication Data

US 2006/0107550 A1 May 25, 2006

(51) Int. Cl.
*A43B 23/00* (2006.01)
*A43B 23/24* (2006.01)

(52) U.S. Cl. ..... 36/136; 2/244; 2/245

(58) Field of Classification Search ..... 36/136, 36/1; 428/99, 7, 24; 2/244, 245
See application file for complete search history.

(56) References Cited

U.S. PATENT DOCUMENTS

| | | | | |
|---|---|---|---|---|
| 1,668,480 | A * | 5/1928 | Stafford et al. | 36/58.5 |
| 1,668,481 | A * | 5/1928 | Stafford et al. | 36/58.5 |
| D84,311 | S | 6/1931 | Whitehouse | |
| 1,855,345 | A | 4/1932 | Fischer | |
| 1,977,995 | A | 10/1934 | Morali | 41/10 |
| 3,656,244 | A * | 4/1972 | Andrade | 36/1 |
| 3,751,769 | A * | 8/1973 | Reiner | 24/300 |
| 3,878,641 | A | 4/1975 | Noble | 46/175 |
| 4,026,047 | A | 5/1977 | Ahmer | 36/136 |
| D291,145 | S | 8/1987 | Allen | D2/317 |
| D300,881 | S | 5/1989 | Dickenson | D2/270 |
| D330,342 | S | 10/1992 | Griffin | D11/6 |
| D342,598 | S | 12/1993 | Harrington | D2/939 |
| D348,347 | S | 7/1994 | Krajci | D2/976 |
| 5,386,710 | A * | 2/1995 | Moore | 63/3 |
| 5,496,612 | A * | 3/1996 | Ransbottom | 428/99 |
| 5,535,531 | A | 7/1996 | Karabed et al. | 36/50.1 |
| 6,241,572 | B1 * | 6/2001 | Braginsky | 446/85 |
| 6,293,285 | B1 * | 9/2001 | Schach | 132/200 |
| 6,418,643 | B1 | 7/2002 | Yang | 36/101 |
| 6,516,538 | B2 | 2/2003 | Kraft | 36/11.5 |
| 6,651,359 | B1 | 11/2003 | Bricker | 36/101 |
| D486,296 | S | 2/2004 | Morrison et al. | D2/917 |
| D490,594 | S | 6/2004 | Wiirre | D2/900 |
| 6,754,983 | B2 | 6/2004 | Hatfield et al. | 36/45 |
| 7,181,931 | B2 * | 2/2007 | White | 63/33 |
| 2004/0078997 | A1 | 4/2004 | Pledger | 36/11.5 |
| 2004/0093765 | A1 | 5/2004 | Baldwin | 36/101 |
| 2005/0166636 | A1 * | 8/2005 | Lazor | 63/38 |

* cited by examiner

*Primary Examiner*—Marie Patterson
(74) *Attorney, Agent, or Firm*—McCarter & English, LLP

(57) ABSTRACT

A removably attachable decoration for footwear is provided. The decoration can be attached to any desired article of footwear, such as a shoe or sandal, at any desired location thereon. The decoration comprises a strand having beads or other adornments attached thereto. One or more elastic bands are provided for removably attaching the decoration to an article of footwear. A hook-shaped tool is provided for attaching the one or more elastic bands to the decoration and about a portion of the article of footwear to retain the decoration in position against the article of footwear. The hook-shaped tool, elastic bands, and decoration could be provided in the form of a kit that can be used with any article of footwear.

11 Claims, 9 Drawing Sheets

REMOVABLY ATTACHABLE DECORATION FOR FOOTWEAR

BACKGROUND OF THE INVENTION

1. Field of the Invention

The present invention relates to a decoration for footwear. More specifically, the present invention relates to a removably attachable decoration for footwear.

2. Related Art

Decorations for footwear are well known in the art, and exist in various forms. For example, shoe decorations have in the past been provided in the form of detachable appliques that can be attached to the sides and upper of a shoe. Other decorations include straps that are removably attachable to portions of a shoe using attachments such as hook-and-loop fasteners. Still other decorations have been provided in the form of permanent ornamentation (e.g., sequins, stones, etc.) attached to desired portions of a shoe.

While existing shoe decorations provide visually-pleasing ornamentation for shoes, typically such decorations can only be applied to a specific shoe or shoe style. For example, shoe decorations that use hook-and-loop fasteners require a component of the fastener (e.g., a hook or loop component of a hook-and-loop fastener) to be permanently attached to the shoe.

Accordingly, what would be desirable, but has not yet been provided, is a removably attachable decoration that can be attached to footwear without requiring modification of the footwear, and which includes attachments that are hidden from view when the decoration is attached to the footwear.

SUMMARY OF THE INVENTION

The present invention provides a removably attachable decoration that can be attached to any desired article of footwear, such as a shoe or sandal, at any desired location thereon. The removably attachable decoration comprises a decoration, such a strand of beads or any other desired decoration, and at least one elastic band for removably attaching the decoration to a portion of an article of footwear. The at least one elastic band is attached to the decoration and extends about a desired portion of an article of footwear to retain the decoration in position against the footwear. The decoration could be attached to a strap of a shoe, or at any other desired location. A plurality of elastic bands could be used to attach the decoration along the length thereof to the article of footwear.

The present invention also provides a method for removably attaching a decoration to an article of footwear. The method comprises the steps of positioning a decoration against a desired portion of an article of footwear; looping a first end of an elastic band about an attachment point of the decoration; stretching the elastic band about the desired portion of the article of footwear; and looping a second end of the elastic band about the attachment point of the decoration. The elastic band can be stretched about the desired portion of the article of footwear using a hook-shaped tool.

The present invention further provides a removably attachable footwear decoration kit. The kit comprises a decoration, such as a strand of beads; a plurality of elastic bands; a hook-shaped tool for attaching the plurality of elastic bands to the decoration and about a desired portion of an article of footwear; and a container for storing the plurality of elastic bands. The container could comprise a reclosable bag, and the hook tool can be stored in the container.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

The present invention provides a removably attachable decoration for footwear. The decoration can be attached to any desired article of footwear, such as a shoe or sandal, at any desired location thereon. The decoration comprises a strand having beads or other adornments attached thereto. One or more elastic bands are provided for removably attaching the decoration to an article of footwear. A hook-shaped tool may be provided for attaching the one or more elastic bands to the decoration and about a portion of the article of footwear to retain the decoration against the article of footwear. The hook-shaped tool, elastic bands, and decoration could be provided in the form of a kit that can be used with any article of footwear.

Figure 1:
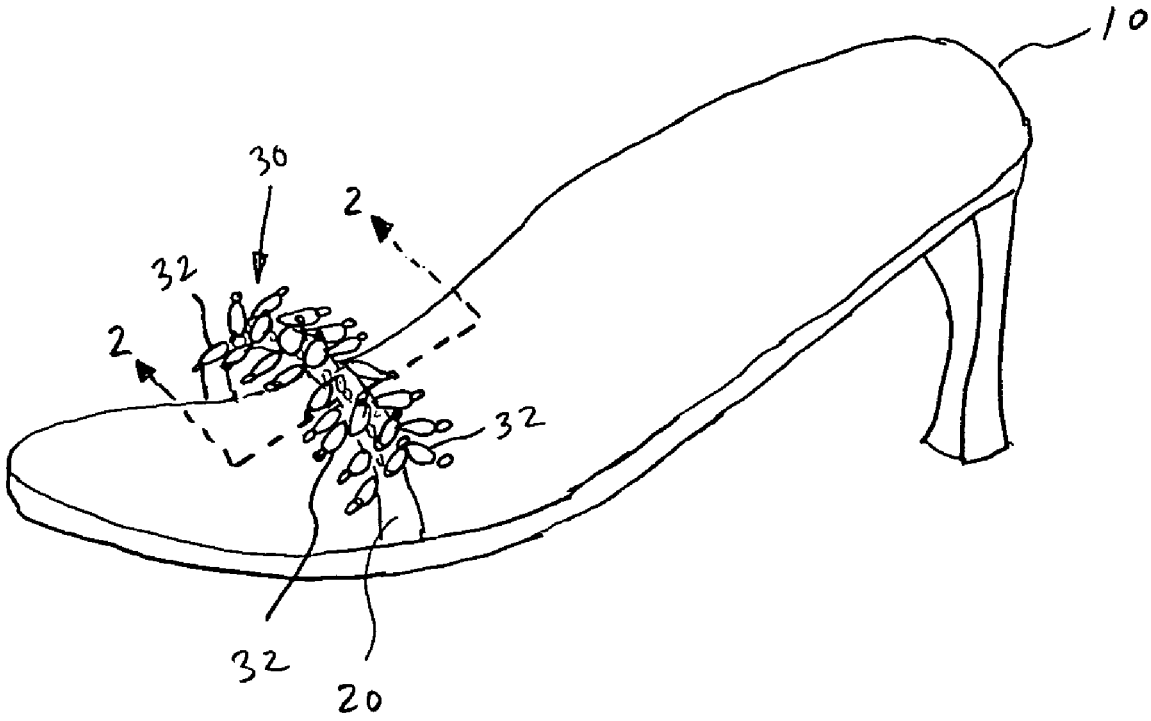
FIG. 1 is a perspective view showing the removably attachable decoration of the present invention attached to an article of footwear.

FIG. 1 is a perspective view showing the removably attachable decoration 30 of the present invention attached to footwear 10. The decoration 30 could be attached to any desired article of footwear, such as a shoe or sandal. The decoration 30 is shown attached to a strap 20 of footwear 10, but could be attached to any desired portion of footwear 10. The decoration 30 comprises a strand of beads 32, but any other desired decoration could be provided. The decoration 30 is removably attached to footwear 10 using one or more elastic bands.

Figure 2:
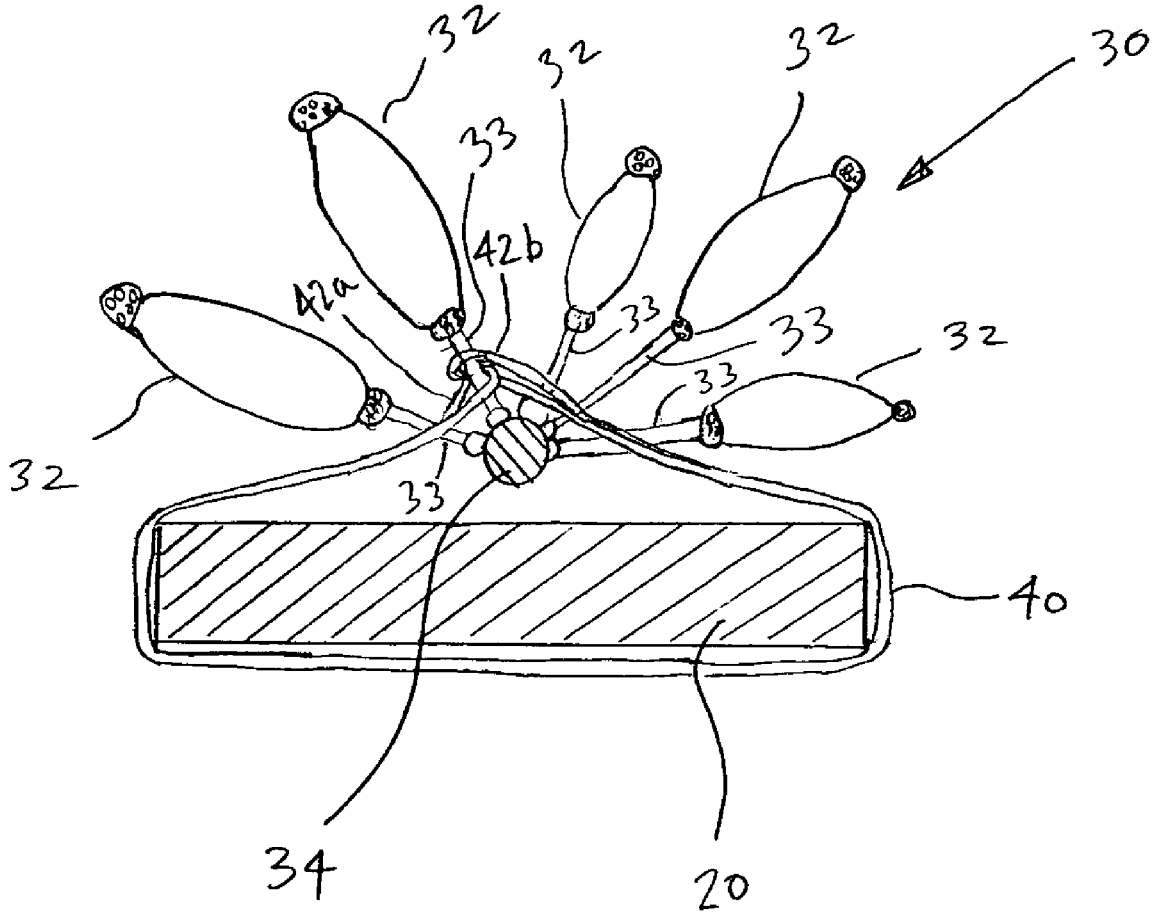
FIG. 2 is a cross sectional view taken along the line 2-2 of FIG. 1, showing the removably attachable decoration of the present invention in greater detail.

FIG. 2 is a cross sectional view taken along the line 2-2 of FIG. 1, showing the removably attachable decoration 30 of the present invention in greater detail. The decoration 30 includes a plurality of beads 32 attached to a strand 34. The beads 32 may be threadably or otherwise engaged with the strand 34 by a tether 33, which can be made of any suitable material such as thread or chain links. Any bead 32 on the decoration 30 can serve as a point of attachment. One or more elastic bands 40 retain the decoration 30 against the strap 20, and can be positioned at ends of the decoration or along the length of the strand 34. The elastic band 40 is positioned around a tether 33 of a bead 32, wrapped about the strap 20, and then positioned back over the bead 32, on the tether 33. As such, opposite ends 42*a* and 42*b* of the elastic band 40 are looped around a tether 33, under a bead 32, and the band 40 is stretched about the strap 20 to retain the decoration 30 against the strap 20. More than one bead could be used as points of attachment, and points of attachment other than beads can also be provided. The bands 40 could be utilized to retain the decoration 30 to any desired portion of an article of footwear.

Importantly, the elastic bands 40 are easily attached to the decoration 30, thereby allowing the decoration 30 to be quickly and conveniently attached to the strap 20. Further, the bands 40 are hidden from view when the decoration 30 is attached to the strap 20, thereby preserving the ornamental appearance of the decoration 30 when the decoration 30 is attached to the strap 20. The bands 40 can be formed from a suitable elastic material and the size thereof can be varied. It has been found that the elastic bands from TP Orthodontics, Inc. (LaPorte, Ind.), having a size of 3/16 of an inch (4.8 mm), work well. Such bands are commonly used by orthodontists in connection with braces. Other sized bands may be used. The bands 40 can be quickly disengaged from the decoration 30 and strap 20, thereby allowing for the quick and convenient removal of the decoration 30 from the shoe 10. The elastic band can be any desirable color including transparent.

Figure 3:
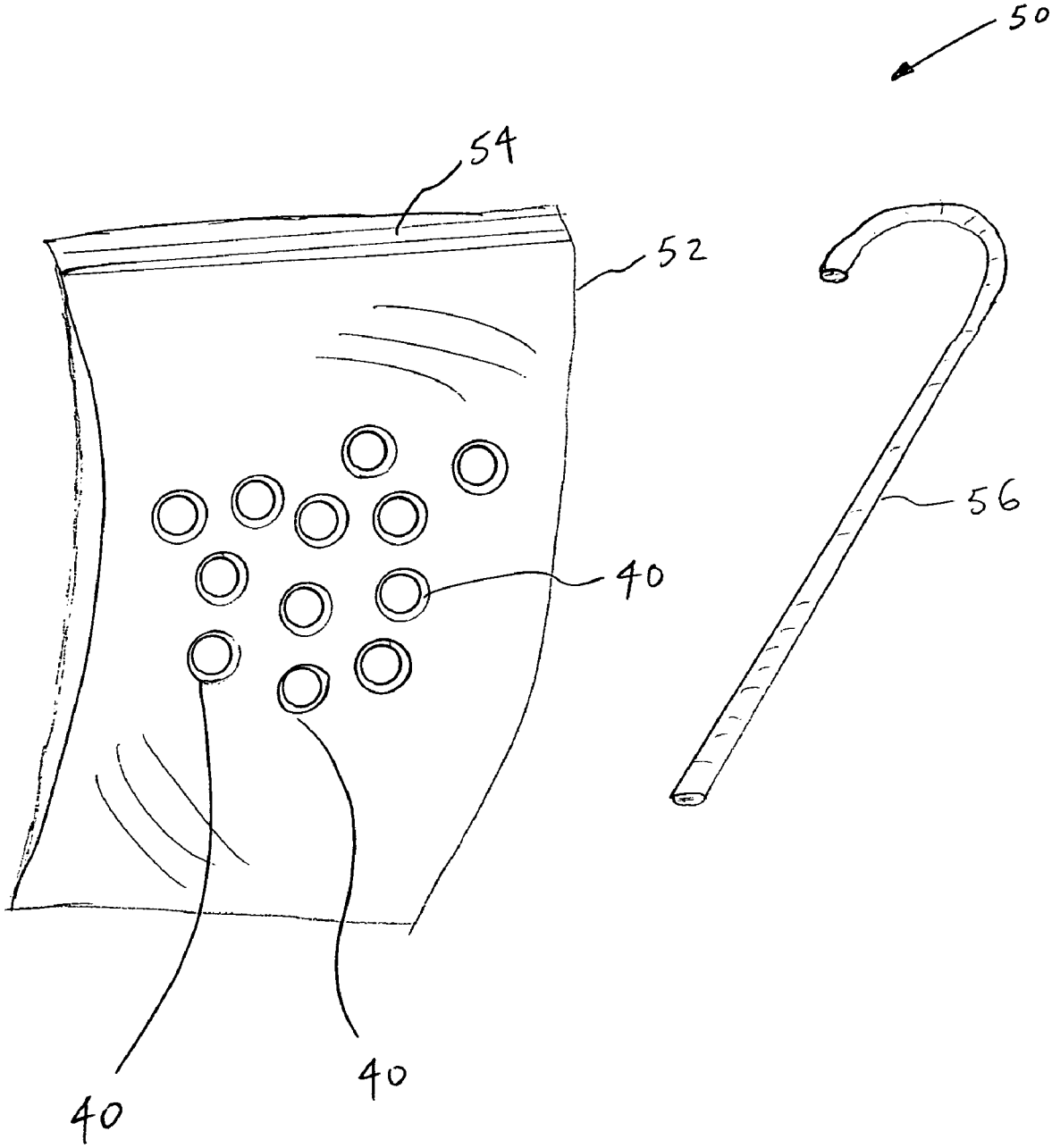
FIG. 3 is a perspective view showing an attachment kit according to the present invention for attaching the removably attachable decoration to an article of footwear.

FIG. 3 is a perspective view showing an attachment kit, indicated generally at 50, for attaching the removably attachable decoration of the present invention to an article of footwear. The kit 50 includes a plurality of elastic bands 40, a container 52 having a closure 54 for storing the elastic bands 40, and a hook-shaped tool 56 for installing the elastic bands 40. The container 52 could comprise a plastic, transparent bag, or any other type of container. Optionally, the hook-shaped tool 56 could also be stored in the container 52.

Figure 4A:
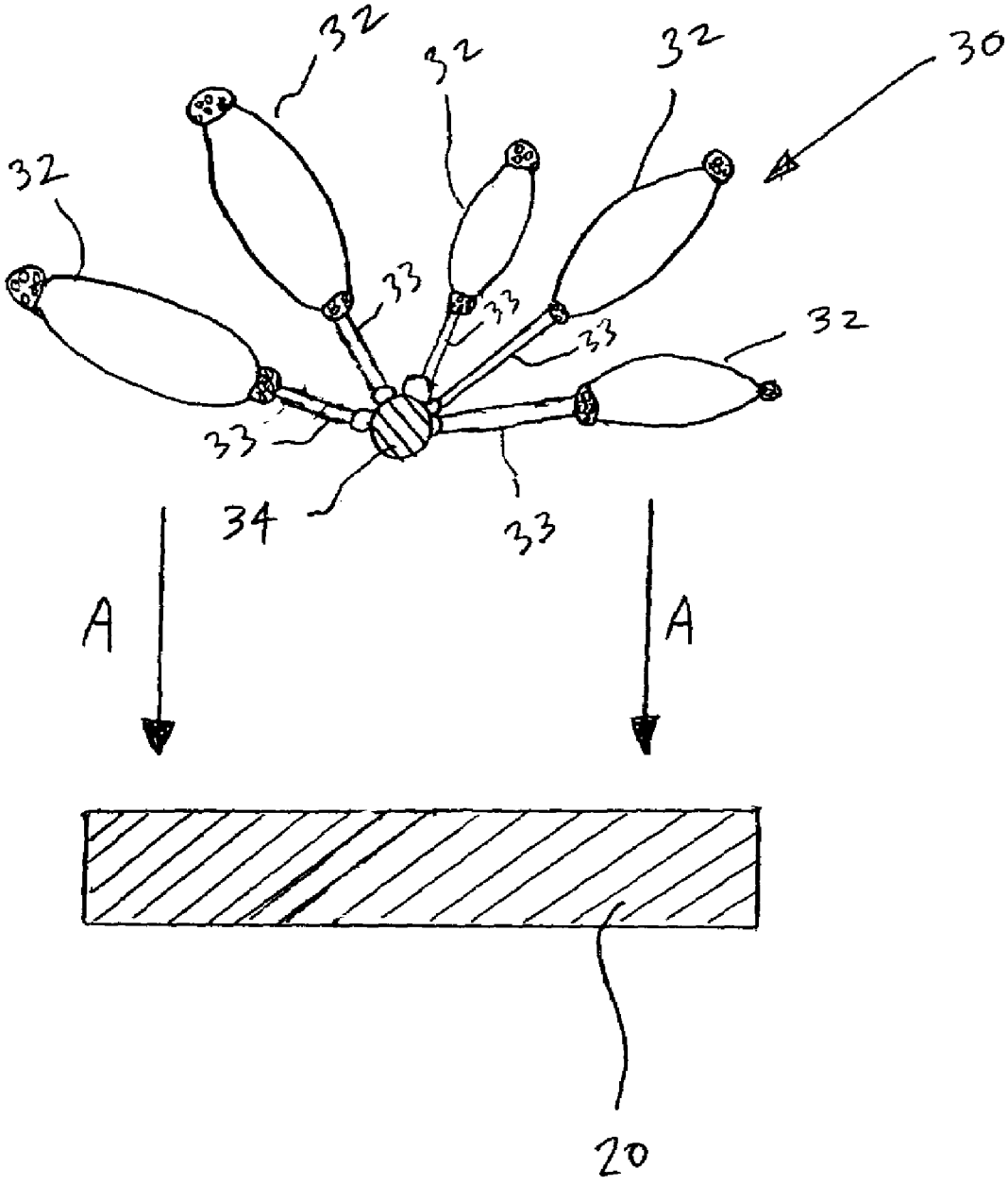
FIGS. 4*a*-4*d* are cross-sectional views showing steps according to the present invention for attaching the removably attachable decoration to an article of footwear.
Figure 4B:
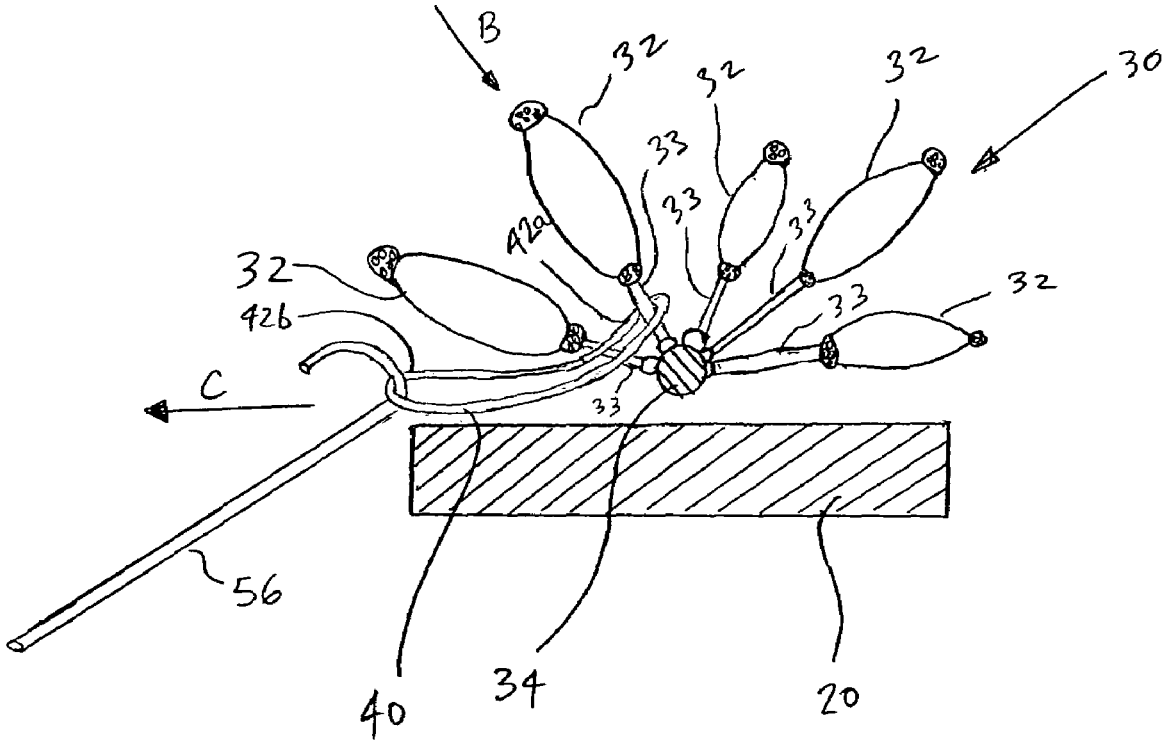

FIGS. 4*a*-4*d* are cross-sectional views showing steps according to the present invention for attaching the removably attachable decoration to an article of footwear. As shown in FIG. 4*a*, the decoration 30 is positioned near a desired location on the article of footwear, such as the strap 20 shown in FIG. 1, in the general direction indicated by arrow A. Then, as shown in FIG. 4*b*, a first end 42*a* of the elastic band 40 is positioned over a bead 32 of the decoration 30, in the general direction indicated by arrow B, and around the tether 33. The hook end of the hook-shaped tool 56 is inserted through the band 40, and the band 40 is then tensioned by pulling the hook-shaped tool 56 away from the decoration 30 in the general direction indicated by arrow C.

Figure 4C:
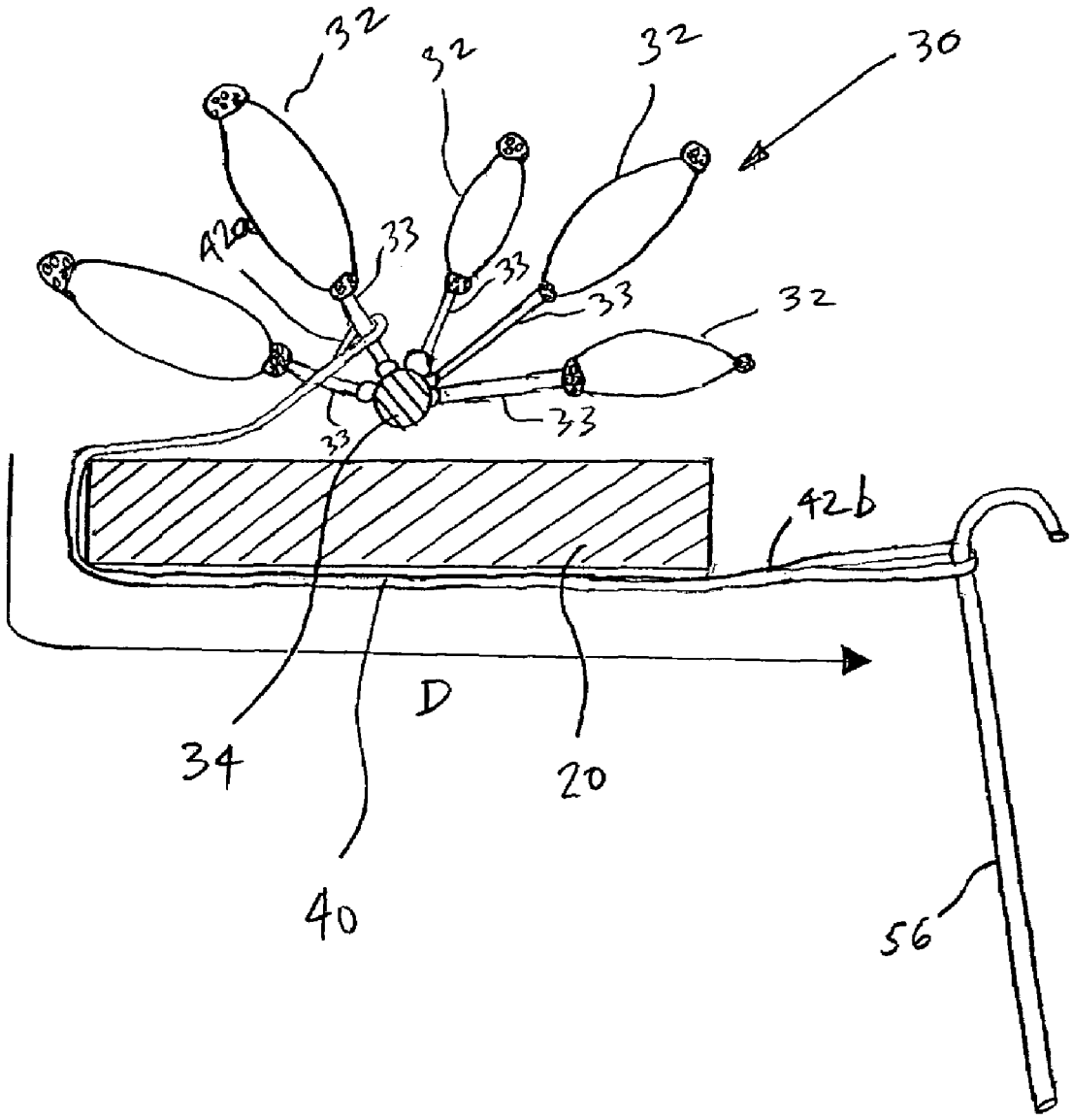
Figure 4D:
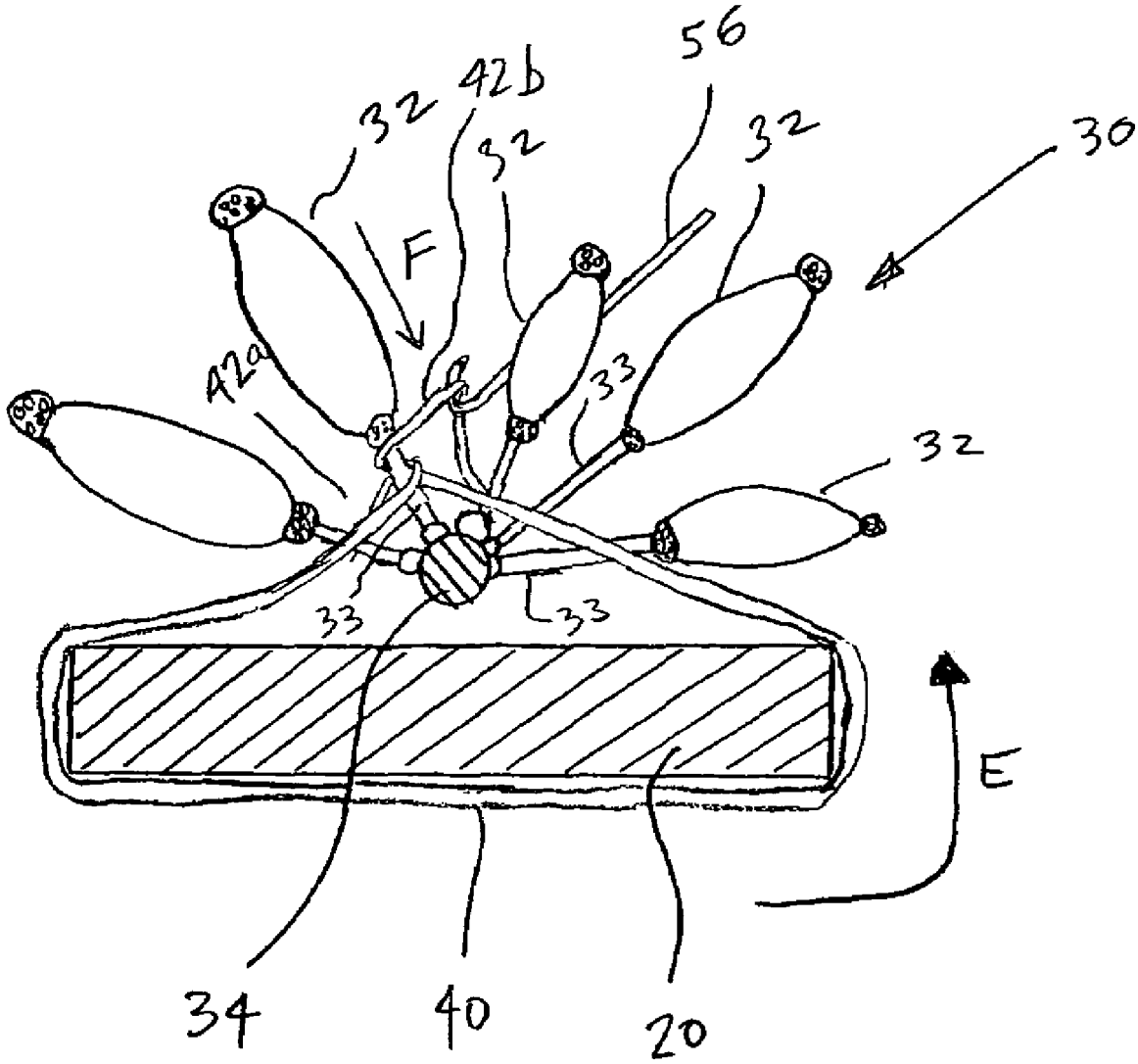

As shown in FIG. 4*c*, the band 40 is stretched around the strap 20 in the general direction indicated by arrow D. Then, as shown in FIG. 4*d*, the band 40 is stretched upward and toward the decoration 30, in the general direction indicated by arrow E. An opposite end 42*b* of the band 40 is then stretched over the bead 32 of the band 40, in the general direction indicated by arrow F, and around the tether 33. The tool 56 can then be removed from the band 40, and the tensioned band 40 snugly retains the decoration 30 against the strap 20. It should be noted that any desired bead 32 of the decoration 30, or any number of beads or other suitable portions of the decoration 30, can be inserted through the ends 42*a* and 42*b* of the band 40 to attach the decoration to an article of footwear.

Figure 5:
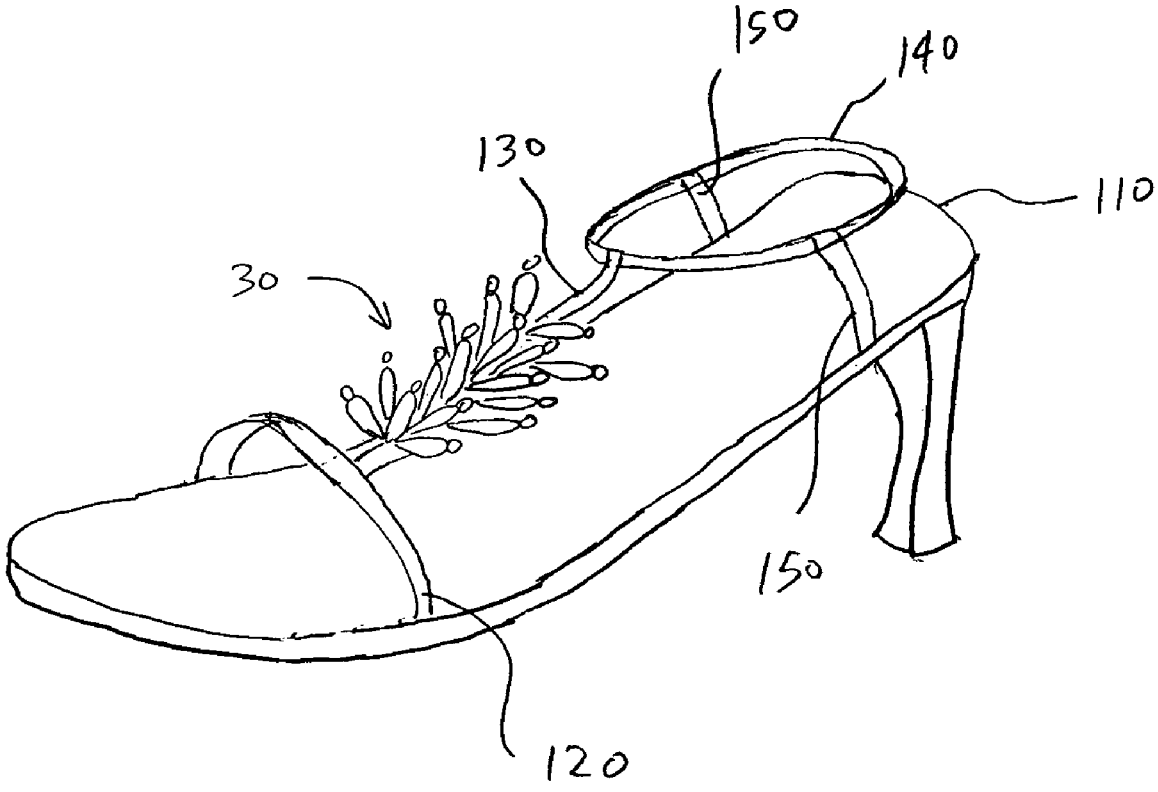
FIG. 5 is a perspective view showing the removably attachable decoration of the present invention attached to a central strap of a woman's shoe.
Figure 6:
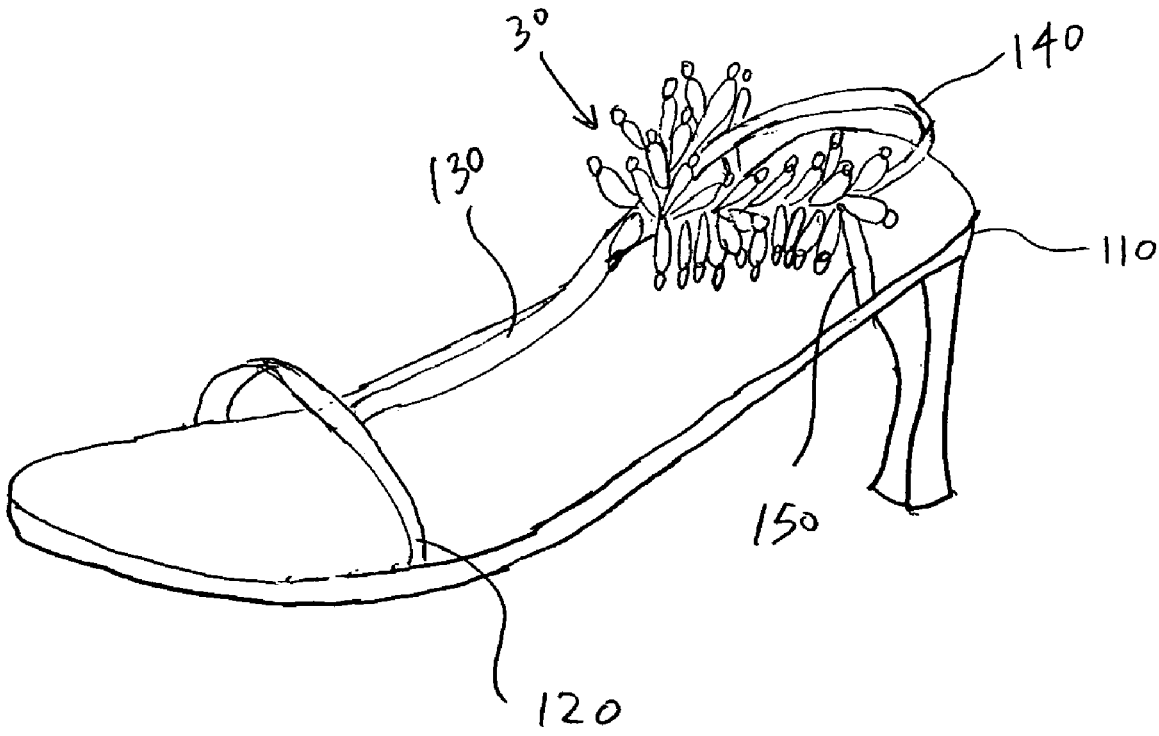
FIG. 6 is a perspective view showing the removably attachable decoration of the present invention attached to a heel strap of a woman's shoe.

As mentioned previously, the present invention can be attached at any desired location on an article of footwear. Such an alternate location is shown in FIG. 5, which is a perspective view showing the removably attachable decoration of the present invention attached to a center strap of a woman's shoe 110. The shoe 110 includes a forward strap 120, a heel strap 140, a center strap 130 interconnecting the forward strap 120 and the heel strap 140, and two side straps 150 interconnecting the heel strap 140 to the shoe 110. The decoration 30 of the present invention is removably attached to the center strap 130 in similar fashion as described above with reference to FIGS. 4*a*-4*d*, using elastic bands. As shown in FIG. 6, the decoration 30 could also be removably attached to the heel strap 140, along any desired portion thereof or along the entire heel strap 140. Thus, as can readily be appreciated the decoration 30 could be attached to any desired portion of an article of footwear. Further, it is conceivable that the decoration of the present invention could also be attached to an article of clothing.

Having thus described the invention in detail, it is to be understood that the foregoing description is not intended to limit the spirit and scope thereof. What is desired to be protected by Letters Patent is set forth in the appended claims.

What is claimed is:

1. A method for removably attaching a decoration to an article of footwear comprising:

positioning a decoration against a desired portion of an article of footwear;

looping a first end of an elastic band about an attachment point of the decoration;

stretching the elastic band about the desired portion of the article of footwear; and looping a second end of the elastic band about the attachment point of the decoration.

2. The method of claim 1, wherein the step of positioning a decoration against the desired portion of the article of footwear comprises positioning a strand of beads against the desired portion.

3. The method of claim 2, wherein the step of looping the first end of the elastic band about the first portion of the decoration comprises looping the first end of the elastic band about a tether of a bead of the strand of beads.

4. The method of claim 3, wherein the step of looping the second end of the elastic band about the attachment point of the decoration comprises looping the second end of the elastic band about the tether of the bead of the strand of beads.

5. The method of claim 1, wherein the step of positioning the decoration against the desired portion of the article of footwear comprises positioning the decoration against a strap of a shoe.

6. The method of claim 5, wherein the step of stretching the elastic band about the desired portion of the article of footwear comprises stretching the elastic band about the strap of the shoe.

7. The method of claim 1, wherein the step of stretching the elastic band about the desired portion of the article of footwear comprises stretching the elastic band about the desired portion of the article of footwear using a hook-shaped tool.

8. A removably attachable footwear decoration kit comprising:

a decoration;

a plurality of elastic bands;

a hook-shaped tool for attaching the plurality of elastic bands to the decoration and about a desired portion of an article of footwear; and a container for storing the plurality of elastic bands.

9. The kit of claim 8, wherein the decoration comprises a strand of beads.

10. The kit of claim 8, wherein the container comprises a reclosable bag.

11. The kit of claim 8, wherein the hook-shaped tool can be stored in the container.

* * * * *